United States Patent [19]

Mowry et al.

[11] Patent Number: 5,062,666

[45] Date of Patent: Nov. 5, 1991

[54] FINANCIAL INSTRUMENT AND METHOD OF MAKING

[75] Inventors: William H. Mowry, Dayton; James H. Schuelke, Vandalia; Robert L. White, Franklin, all of Ohio

[73] Assignee: The Standard Register Company, Dayton, Ohio

[21] Appl. No.: 473,929

[22] Filed: Feb. 1, 1990

[51] Int. Cl.[5] ..... B42D 15/00

[52] U.S. Cl. ..... 283/67; 283/57; 283/58

[58] Field of Search ..... 283/57, 58, 114; 282/DIG. 1; 434/194; 101/483

[56] References Cited

U.S. PATENT DOCUMENTS

| | | | |
|---|---|---|---|
| D. 304,458 | 11/1989 | Mowry | D18/24 |
| 936,399 | 10/1909 | Angell | 283/58 |
| 1,144,742 | 6/1915 | Todd et al. | 283/58 |
| 1,145,447 | 7/1915 | Todd et al. | 283/58 |
| 1,564,724 | 12/1925 | Todd et al. | 283/58 |
| 3,112,151 | 11/1963 | Buros | 283/58 |
| 3,983,814 | 10/1976 | Baker | 101/483 |
| 4,036,134 | 7/1977 | Funaki | 101/483 |
| 4,175,774 | 11/1979 | Tonges et al. | 283/93 |
| 4,234,214 | 11/1980 | Lee | 283/57 |
| 4,681,348 | 7/1987 | Mowry, Jr. | 283/57 |
| 4,733,887 | 3/1988 | Mowry | 283/58 |
| 4,749,213 | 6/1988 | Mowry | 283/58 |

FOREIGN PATENT DOCUMENTS

| | | | |
|---|---|---|---|
| 469015 | 7/1914 | France | 283/58 |
| 692505 | 11/1930 | France | 283/58 |
| 4119 | of 1903 | United Kingdom | 434/194 |

*Primary Examiner*—Mark Rosenbaum
*Assistant Examiner*—Hwei-Siu Payer
*Attorney, Agent, or Firm*—Killworth, Gottman, Hagan & Schaeff

[57] ABSTRACT

An international financial instrument has a multi-letter international monetary code printed on the face thereof in a first area and an amount printed on the face thereof in a second area. The letters making up the monetary code are printed in a negative pattern and formed by a series of rows of printed dots which define the outlines for the letters. The name of the currency denomination corresponding to the multi-letter international monetary code may be printed in at least one line overlapping the multi-letter international monetary code. Each of the letters may be printed in a negative pattern that includes an open area in which a smaller version of the letter is printed in a positive pattern.

40 Claims, 6 Drawing Sheets

FINANCIAL INSTRUMENT AND METHOD OF MAKING

BACKGROUND OF THE INVENTION

Many techniques have been proposed to protect financial instruments, such as checks and money orders, from nefarious tampering, such as for example fraudulently raising the amount of the instrument. Safety papers have been developed which have chemically reactive coatings that can change color or bleach out a color and reveal a warning word, such as "VOID", thereby showing that an attempt has been made to alter the instrument. Printing techniques have also been used on the back of documents using an ordered large repeating pattern, any change in which should be quickly detected by the human eye.

Several patents disclose various methods for providing secure financial instruments. For example, Todd, U.S. Pat. No. 1,564,724, discloses a commercial paper having solid, positive numerical characters which document are printed with a field of words. Preferably, the field of words for each numerical figure is formed by printing a repetition of groups of letters spelling the corresponding figure word, so that the field is different for each numerical figure. The figures of Todd are preferably limited or terminated by other characters or words for the purpose of preventing the changing of the inscription by adding or inserting other figures.

Angell, U.S. Pat. No. 939,399, discloses a method of protecting commercial paper which utilizes a die set to form figures by cutting into or indenting paper in an area surrounding a numeral or letter, while leaving the area corresponding to the numeral or letter untouched. The surrounding, die impressed areas are constructed so that their exterior outlines are varied. This variation in the exterior outlines and the spacing between figures cooperates so that clear or blank portions of the paper intervene between adjacent figures.

Tonges et al, U.S. Pat. No. 4,175,774, discloses a document having a printed background which, upon copying by a photocopy machine, produces a document which can be readily distinguished from the original. To achieve this feature, the background of the Tonges document is printed with a set of larger dots and a set of smaller dots. The larger dots are of a size which can be reproduced by a copying machine. The smaller dots are of a size that the copying machine cannot reproduce.

Also of interest is French Brevet D'Invention No. 692,505.

Although not relating to methods for protecting the amount figure of a security instrument, several other patents disclose subject matter of interest. For example, Lee, U.S. Pat. No. 4,234,214, discloses a combination of alphanumeric characters for use in forming a serial number of a bank note. An ink jet printer is used to form a multi-colored or patterned field which defines a negative alphanumeric character. Burros, U.S. Pat. No. 3,112,151, relates to a method for correcting mistakes in magnetically encoded characters, such as the magnetically readable characters typically found on the bottom portion of a check. Baker, U.S. Pat. No. 3,983,814, relates to a front of alphanumeric characters which are believed to be more easily readable than conventional characters.

Notwithstanding the above described efforts to make financial instruments more secure, techniques still exist for altering checks and money orders. In order to frustrate financial instrument protection techniques, such as those discussed above, persons interested in altering an instrument have developed a cut and paste scheme. In the cut and paste method of alteration, a person obtains two instruments. One instruments may be for $9.00 and the second for $100.00. Using a scalpel the person carefully removes the 9 from the first instrument and the 1 from the second. The 9 is then pasted into the area where the 1 had been removed, thereby fraudulently raising the amount of the instrument to $900.00.

Techniques have been developed to deter fraudulent alteration of financial instruments through this cut and paste scheme. One such technique is shown in Mowry, U.S. Pat. No. 4,733,887, Mowry, U.S. Pat. No. 4,749,213, and Mowry, U.S. Pat. No. Des. 304,458. In this very successful approach, a financial instrument has an amount printed on its face, with the digits making up the amount being printed by a dot matrix printer in a negative pattern. Each of the digits includes a boundary portion formed by a single row of dots which makes up a portion of the outline of the adjoining digit. The digits are designed to be of varying widths. Each of these features makes cut and paste alteration of the printed financial instrument more difficult. Additionally, other methods of document alteration are made more difficult by the fact that each digit has an open, unprinted area within which the name of the digit is printed in letters, and the dots defining each digit are arranged in rows which are spaced sufficiently to allow a portion of the underlying paper to be seen. Further, the shapes of the various digits are selected such that it is very difficult to alter one digit by additional printing to produce another, properly formed digit.

While this technique is quite effective with domestic money orders, it is not sufficient to prevent fraudulent alteration of financial instruments which can be made out in any of an number of national currencies. Due to exchange rates, if a document carrying an amount in one national currency were to be altered to reflect a different currency, the value of the document could be altered dramatically. Typically, international financial instruments, such as bank drafts, carry a three letter code, termed a multi-letter international monetary code, which indicates the national currency in which the amount is printed. By simply altering this three letter code, as by the cut and paste method described above or by other alteration techniques, it has been possible to fraudulently increase the amount of an international financial instrument.

Accordingly, there still exists a need in the art for an international financial instrument and method of preparation which make alteration of the monetary amount of the instrument difficult and readily detectable.

SUMMARY OF THE INVENTION

This need is met by an international financial instrument and a method of preparing the instrument in which a multi-letter international monetary code is printed on the face of the instrument in a first area and an amount is printed on the face of the instrument in a second area. The letters making up the monetary code are printed in a negative pattern and formed by a series of rows of printed dots which define the outlines of the letters.

The name of the currency denomination corresponding to the multi-letter international monetary code may be printed in at least one line overlapping the first area.

The amount and the multi-letter international monetary code may be arranged in a row. The line of the name of the currency denomination overlaps the first and second areas. The name of the currency denomination may be printed in two lines, a first line above and a second line below the first and second areas and overlapping therewith: The name of the currency denomination may be repeated in the line.

The right-most name of the currency denomination in the line may be right edge justified with the first and second areas.

The monetary code is defined by a plurality of adjoining letters in which a single vertical row of dots forms at least a portion of the outline for each of the adjoining letters, thereby making alteration of the monetary code difficult. Sufficient spacing may be provided between the rows of dots to create a series of voids through which the color of the face of the international financial instrument can be discerned. The voids are sufficiently small to render them substantially incapable of faithful reproduction by photocopying.

Each of the letters printed in a negative pattern preferably includes an open area within which the letter may be printed in a smaller size. At least some of the letters printed in a negative pattern preferably include an open area within which the letter is printed twice. The name of the currency denomination corresponding to the multi-letter international monetary code may be printed in at least one line overlapping the first area by a series of rows of printed dots that are sufficient in number and spacing so as to provide a darker appearance than the multi-letter international monetary code.

The widths of the letters making up the multi-letter international monetary code preferably vary. A spacing symbol may be printed between the first and second areas.

A method of preparing a secure international financial instrument comprising the steps of: a) providing an instrument having a first area thereon in which a monetary code is to be inserted, and a second area thereon in which an amount is to be inserted, b) printing in the first area a monetary code using letters printed in a negative pattern formed by a series of rows of printed dots which define the outline of the letters, and c) printing in the second area an amount.

The step of printing in the second area an amount may comprise the step of printing digits in a negative pattern formed by a series of rows of printed dots which define the outline of the digits. The step of printing in the first area a monetary code may comprise the step of printing a plurality of adjoining letters in which a single row of dots forms at least a portion of the outline for each of the adjoining letters.

The step of printing in the first area a monetary code may comprise the step of printing the letters with a dot matrix printer. The series of rows of printed dots are preferably printed with sufficient spacing to create a series of voids through which the color of the instrument can be discerned. The step of printing in the first area a monetary code using letters printed in a negative pattern may include the step of printing each letter with an open area within which the same letter is printed in a positive pattern in a smaller size.

The step of printing digits in a negative pattern and formed by a series of rows of printed dots which define the outline of the digits may comprise the step of printing the digits with a dot matrix printer. The series of rows of printed dots are printed with sufficient spacing to create a series of voids through which the color of the instrument can be discerned.

The name of the currency denomination corresponding to the multi-letter international monetary code may be printed in at least one line overlapping the first area. The amount and the multi-letter international monetary code are preferably arranged in a row, with the line of the name of the currency denomination overlapping the first and second areas. The name of the currency denomination may be repeated in the line. The name of the currency denomination may be right justified with the first and second areas. The name of the currency denomination corresponding to the multi-letter international monetary code may be printed in at least one line overlapping the first area by a series of rows of printed dots which are sufficient in number and spacing so as to provide a darker appearance than the multi-letter international monetary code. The name of the currency denomination may be printed in two lines, a first line above and a second line below the first and second areas and overlapping therewith.

The widths of the letters making up the multi-letter international monetary code vary. A spacing symbol may be printed between the first and second areas.

Accordingly, it is an object of the present invention to provide an improved international financial instrument and a method of preparing the instrument in which greater document security is provided; to provide such an international financial instrument and method which may advantageously include a multi-letter international monetary code printed on the face of the instrument in a first area and an amount printed on the face of the instrument in a second area with the multi-letter international monetary code and the amount formed by rows of dots; and to provide such an international financial instrument and method in which the letters and digits forming the multi-letter international monetary code and the amount have open areas in which corresponding letters and digits are printed, respectively.

Other objects and advantages of the invention will be apparent from the following description, the accompanying drawings and the appended claims.

DETAILED DESCRIPTION OF THE PREFERRED EMBODIMENT

Figure 1A:
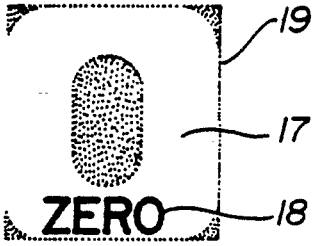
FIGS. 1A through 1J illustrate a negative pattern digit set used for printing the amount on an international financial instrument in accordance with the present invention.
Figure 1B:
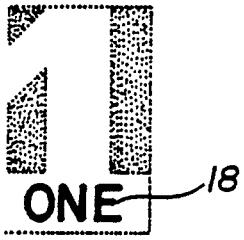
Figure 1C:
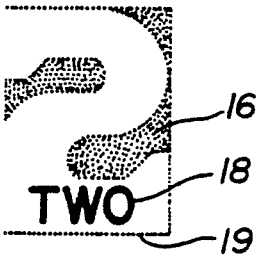
Figure 1D:
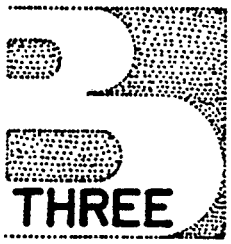
Figure 1E:
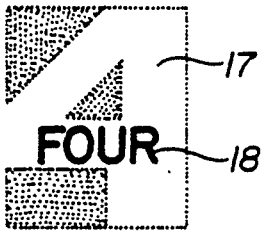
Figure 1F:
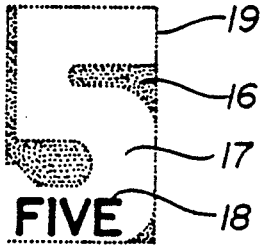
Figure 1G:
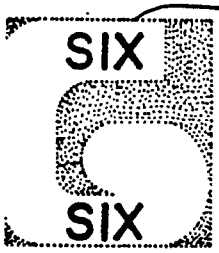
Figure 1H:
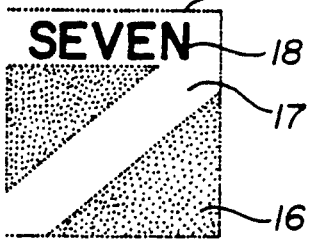
Figure 1I:
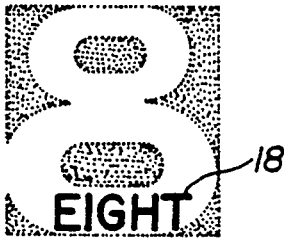
Figure 1J:
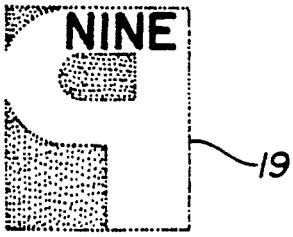
Figure 2:
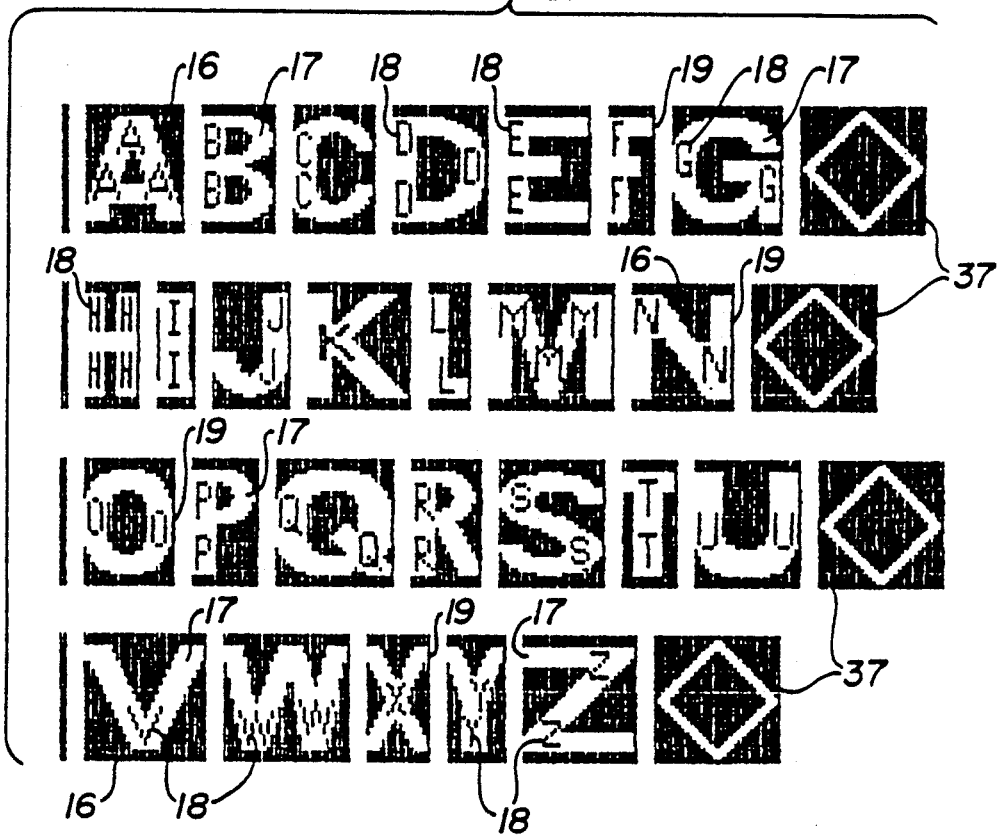
FIG. 2 illustrates a negative pattern font of letters used for printing a multi-letter international monetary code on an international financial instrument.
Figure 3:
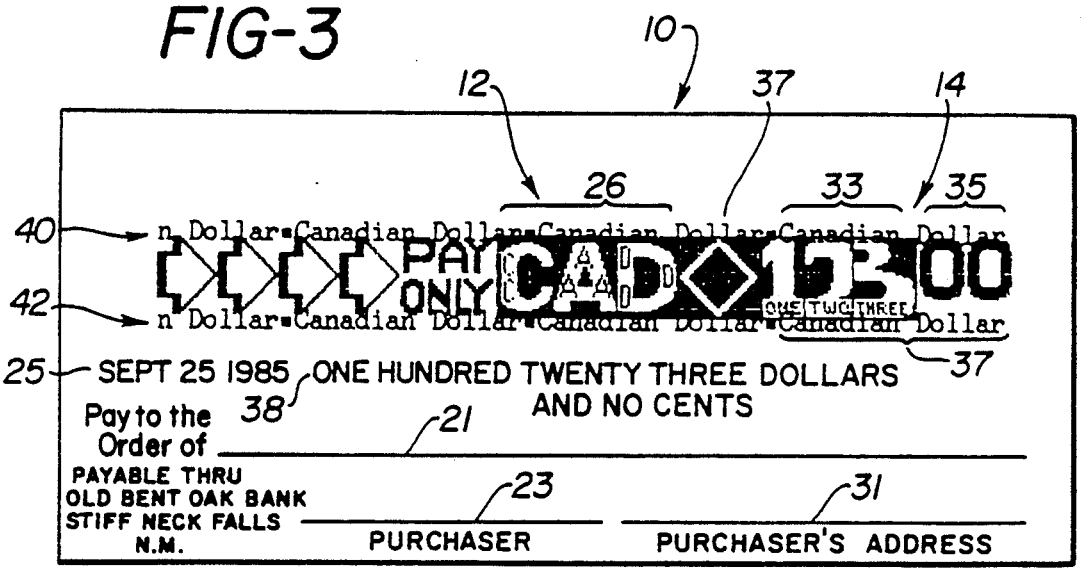
FIG. 3 is a plan view of an international financial instrument illustrating the use of the digit set of FIG. 1 and the negative pattern font of letters of FIG. 2 to complete the instrument in accordance with the present invention.

The present invention relates to an international financial instrument, an example of which is shown in FIG. 3 and indicated by reference numeral 10, and a method by which the instrument is made. The instrument 10 has a multi-letter international monetary code 12 printed on the face of the instrument in a first area. This standardized three letter code specifies the national currency (e.g., Swedish Krona, U.S. Dollars, Italian Lira, Mexican Pesos) to which the instrument 10 relates. In the instrument shown in FIG. 3, the three letter code "CAD" indicates that the instrument specifies Canadian dollars. The letters making up the monetary code 12, an exemplary font of which is shown in FIG. 2, are printed in a negative pattern and formed by a series of rows of printed dots that define the outlines for the letters.

The instrument 10 also has an amount 14 printed on the face of the instrument in a second area. In the instrument shown in FIG. 3, the amount specified is $123.00 Canadian dollars. The digits making up the dollars amount are printed in a negative pattern, shown in FIGS. 1A through 1J, which is formed by a series of rows of printed dots that define the outlines for the digits. The cents amount is shown printed in a positive pattern, with the size of the digits somewhat less than the negative pattern digits used to specify the dollars amount.

Each of the letters A through Z, and each of the digits 0 through 9, has a distinct size and shape, and a unique area included within a rectangle bounding the configuration of the letter or digit. To assist in identification and authentication, the name of each digit can be included within the configuration. The English language names are illustrated in FIGS. 1A through 1J. The digit names can be changed to correspond to the language of any country where the number set is used. Each of the digits of the digit set for the major amount is formed in a negative pattern. The digits may be formed by a series of rows of dots printed by a dot matrix printer, preferably in the printer's graphics mode.

Similarly, each letter used to print the multi-letter international monetary code 12 on the international financial instrument 10 is printed in a negative pattern that includes an open area within which the letter is printed at least once in a smaller size. In many instances, the letter is printed twice or in a positive pattern within an open area defined within the larger negative pattern. The letters may also be formed by a series of rows of dots printed by a dot matrix printer. It will be appreciated that either the letters or digits, or both, may be printed by means other than dot matrix printers, if desired.

The rows of printed dots define the outline for the letters and digits. Thus, each of the letter and digit characters so formed by the negative printing pattern of the present invention includes three portions: the background portion 16 comprising the rows of printed dots, the open area portion 17 defined by the outline of the background portion 16, and the smaller name or letter portion 18 which consists of the printed name of the particular digit, or the letter printed in a smaller size. Additionally, the background portion 16 of each digit or letter includes a boundary portion 19 comprising a single row of printed dots. The boundary portion 19 forms at least a portion of the outline of each letter or digit, and aids in increasing the difficulty of altering the letter or digit when printed in combination with adjoining letters or digits, as more fully described below.

Several advantages are obtained by the use of negative pattern digits and letters. One advantage is that the negative pattern makes alteration more difficult. The negative pattern digits and letters of the present invention are difficult to alter because excess ink has to be removed from or added to the financial document to effect alteration. It is very difficult to remove ink from a document without damaging the document. Also, it is difficult to add ink to the document which will match the ink of the existing digits and letters. The use of negative pattern digits and letters also allows intelligible, printed messages, which are pre-printed on the document, to be seen in the portions 17 of the digits and letters.

The digits and letters used to print the amount and the multi-letter international monetary code in the present invention are preferably printed with a dot matrix printer (not shown) in the printer's graphics mode. The characteristics of the printing performed by a dot matrix printer increase the difficulty of altering the digits and letters so printed. A dot matrix printer forms the digits and letters from a pattern of pin strikes which form an array of dots. Generally, the horizontal spacing between the dots will be different than the vertical spacing between the dots. Although the dots are spaced closely together, a series of voids still exist between the dots which permit the background color of the document to be seen through the background portion 16 of the digits and letters. The voids prevent the background portion 16 of the digits and letters from appearing as a solid mass of printing. Thus the presence of the voids renders more difficult the forger's task of duplicating the background portion 16 of the digit, by imparting a unique texture to the document. The unique texture created by the voids also helps to prevent alteration techniques using photocopying. Many photocopying machines do not have sufficient resolution capabilities to be able to reproduce the rather small voids rendering the voids substantially incapable of faithful reproduction. The background portion 16 is reproduced as a solid mass of printing.

Additionally, by use of a dot matrix printer to form the outline of the digits and letters, a single vertical row of dots can be utilized to form at least a portion of the outline of adjoining digits and letters. As illustrated in FIGS. 1 and 2, all of the digits and letters have some portion of their respective left edges open when standing alone. The left edge is closed by the last row of dots on the right edge of the left adjacent digit or letter when printed. Thus, boundary portion 19 of each digit will form at least a portion of the outline of an adjoining digit and boundary portion 19 of each letter will form at least a portion of the outline of an adjoining letter when the digits and letters are printed on the financial instrument. This further increases the difficulty of altering digits and letters on the instrument by the "cut and paste" method.

As shown in FIG. 3, a second, smaller digit may be utilized for printing a small component of the currency denomination. Preferably, these minor digits have a substantial contrast to the major digit set of FIGS. 1A through 1J. Similar to the background portions of the major digits and letters, the number portions of the minor digits are formed by a series of dots printed by a dot matrix printer.

In FIG. 3, the representative financial instrument 10 is shown having a line 21 for the identification of the payee. A line 23 is provided for the identification of the payor or purchaser, and a place 25 is provided for the date the instrument 10 was prepared. The instrument 10 also includes a first area 26 for the entry of the multi-letter international monetary code 12, and a second area 27 for the entry of the amount or value 14 of the instrument 10, as well as a place 38 where the same amount or value is spelled out. An area 31 is provided for entering the address of the payor or purchaser.

Although the major digit amount 33 and the multi-letter international monetary code is shown in the drawings as appearing in a white on black configuration, and the minor digit 35 appears in a black on white configuration, it will be understood that the "white on black" and "black on white" configurations are relative. When the major amount 33 or the multi-letter international monetary code is entered on a negotiable instrument, the background color in the area 27 will be the color appearing within the bounds of the digits or letters. The color of the ink used in the printer along with any color formed in the area 27 through the use of a carbonless color developing system will determine the ultimate color of the "black" used to enter the minor digits 35.

Immediately to the left of the leftmost multi-letter international monetary code 12, such words as "PAY ONLY" may be used to contain and define the first and second areas 26 and 27 on the left, thus reducing the risk of alteration. A diamond shaped spacing symbol 37 is printed between the first and second areas 26 and 27, and is printed in a negative pattern. This spacing symbol 37 helps clearly separate the amount and the multi-letter international monetary code, and reduces the likelihood of mistaking a letter of the international monetary code 12 for the most significant digit of the amount 14.

Also printed on the exemplary financial instrument 10 shown in FIG. 3 is the amount of the instrument spelled out in words in line 38. Such an arrangement adds to the difficulty encountered when an alteration of the amount of the instrument is attempted. It will be appreciated that, depending upon the memory available in the printing system used to print the instrument 10, it may be desireable to omit line 38.

Figure 4A:
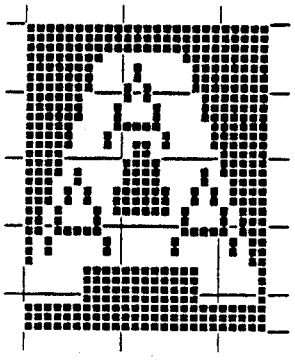
FIGS. 4A through 4Z illustrate the placement pattern for the rows of printed dots which define the outlines of the letters.
Figure 4B:
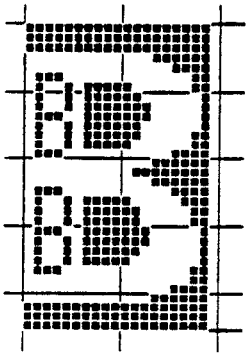
Figure 4C:
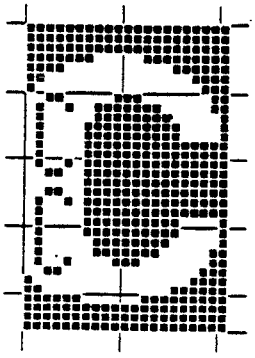
Figure 4D:
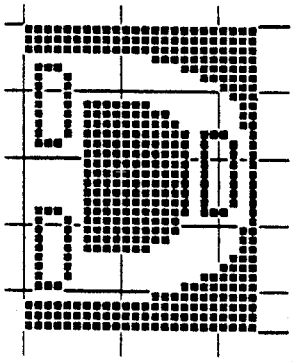
Figure 4E:
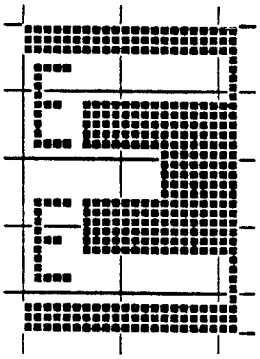
Figure 4F:
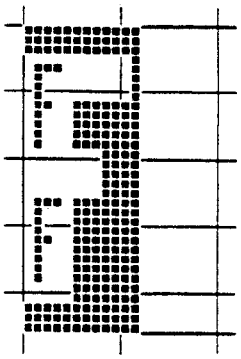
Figure 4G:
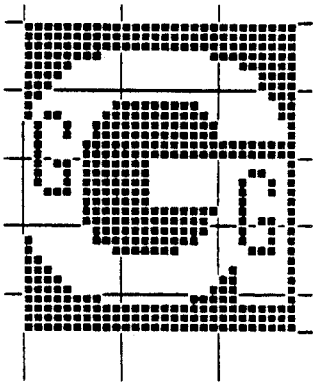
Figure 4H:
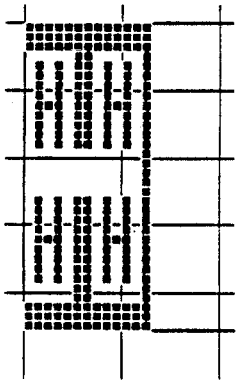
Figure 4I:
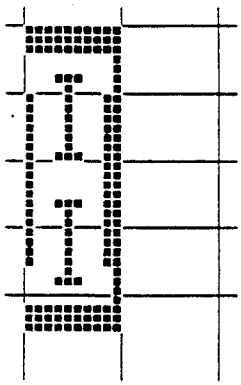
Figure 4J:
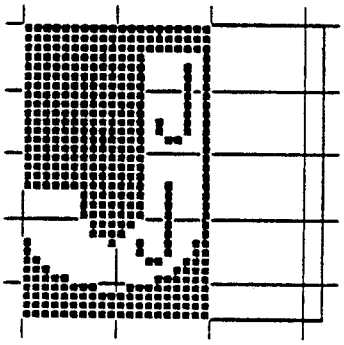
Figure 4K:
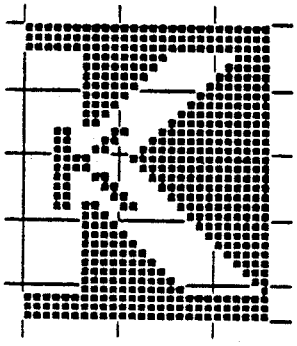
Figure 4L:
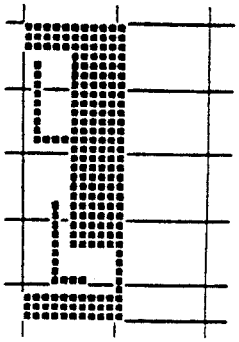
Figure 4M:
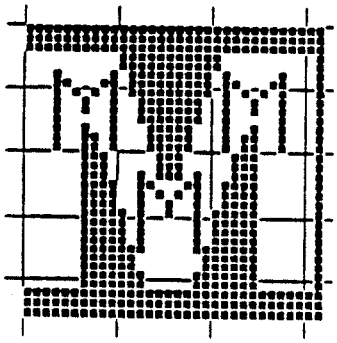
Figure 4N:
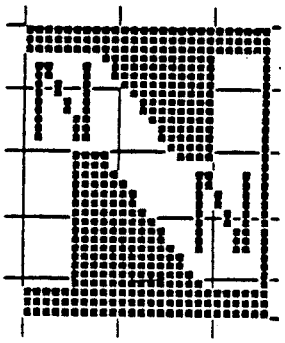
Figure 4O:
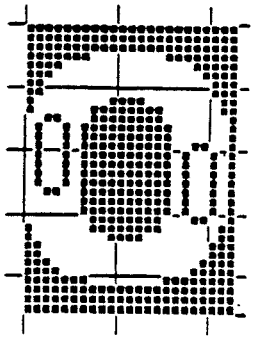
Figure 4P:
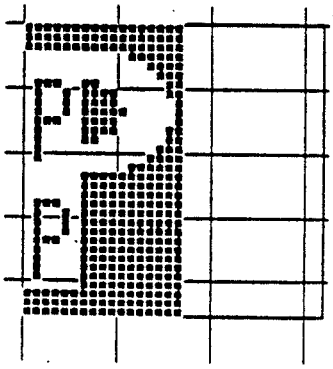
Figure 4Q:
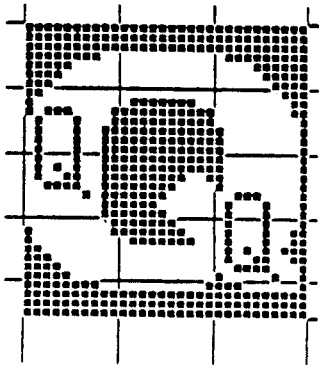
Figure 4R:
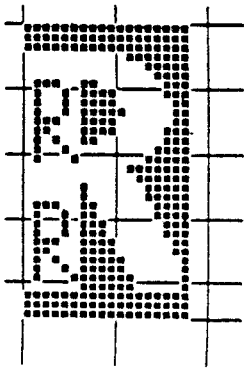
Figure 4S:
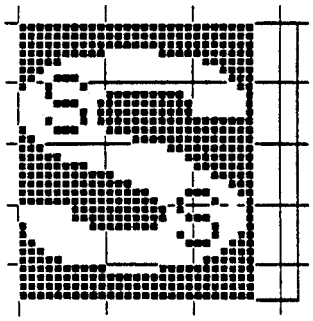
Figure 4T:
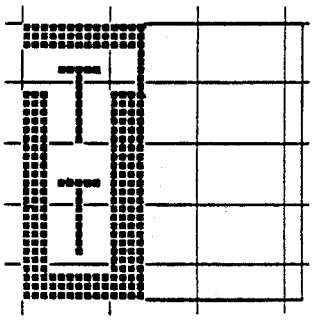
Figure 4U:
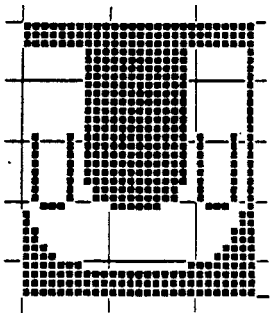
Figure 4V:
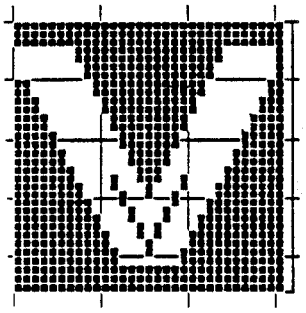
Figure 4W:
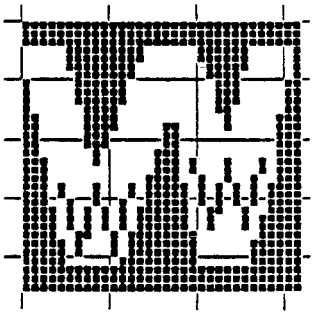
Figure 4X:
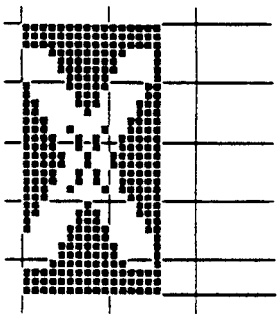
Figure 4Y:
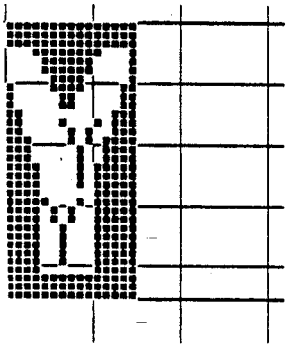
Figure 4Z:
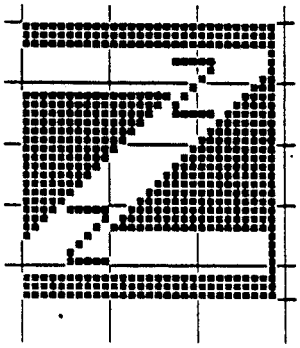
Figure 5:
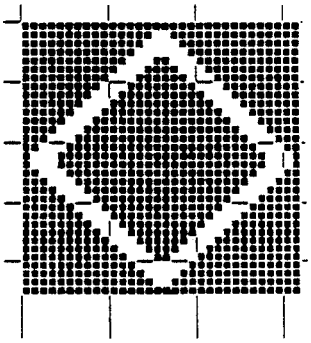
FIG. 5 illustrates a negative pattern spacing symbol that may be printed between the multi-letter international monetary code and the amount.
Figure 6A:
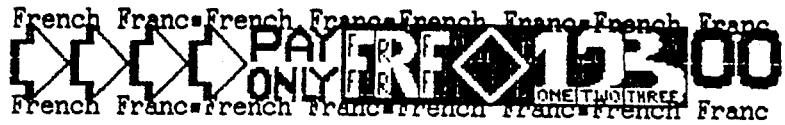
FIGS. 6A through 6E illustrate printing the combination of an amount, a multi-letter international monetary code, and a spacing symbol, with the name of the currency denomination being printed in two lines, a first line above and a second line below the amount, the multi-letter international monetary code, and the spacing symbol.
Figure 6B:
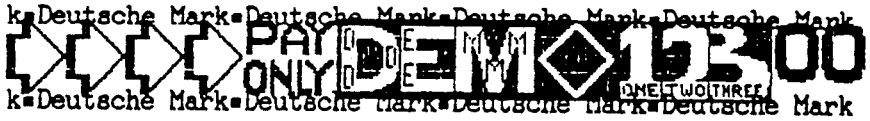
Figure 6C:
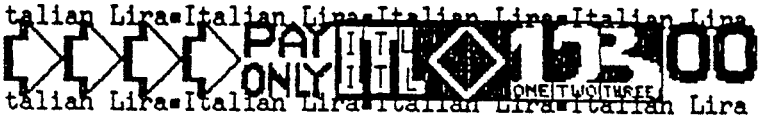
Figure 6D:
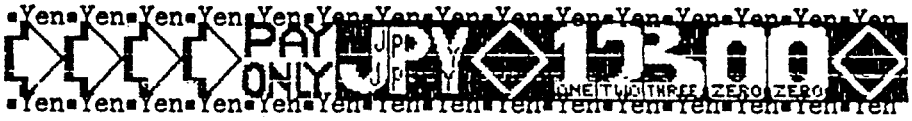
Figure 6E:
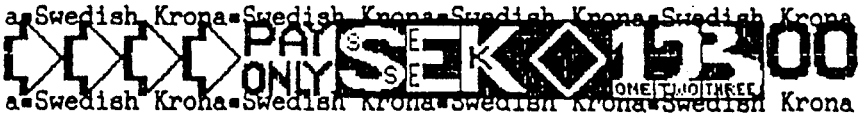

The dot pattern for forming one font of letters is shown in FIGS. 4A through 4Z, and the dot pattern for forming the spacing symbol 37 is shown in FIG. 5. This pattern is only exemplary. It will be appreciated that patterns may be adjusted to accommodate letters of greater or lesser height, or for a matrix printer having differing dot spacing. Further, while the dot pattern is shown as formed by neatly ordered, precisely positioned rows and columns of black squares, the actual printed letters will have a much more irregular appearance, owing to variations in actual dot spacing and in the size and shapes of the dots making up the background portion 16 of the letters.

As shown in FIG. 4, the widths of the letters making up the multi-letter international monetary code 12 vary, from 10 dots wide to 32 dots wide. If an attempt is made to raise the amount of the instrument 10 by superimposing different letters for the monetary code to change the currency of the instrument, it can be seen that the alteration would be clearly visible due to the substantial difference in width of the letters.

In order to make alteration of the instrument even more difficult, the instrument of the present invention may have the name of the currency denomination (for example, "Canadian Dollar" in the instrument shown in FIG. 3) corresponding to the multi-letter international monetary code printed in at least one line 40, preferably overlapping the first area 26, or the second area 27. When the amount 14 and the multi-letter international monetary code 12 are arranged in a row, the name of the currency denomination may be printed in one line to overlap both areas 26 and 27. If desired, the name of the currency denomination may be printed in two lines, a first line 40 above and a second line 42 below the first and second areas 26 and 27, respectively. and overlapping therewith. The name of the currency denomination is preferably repeated in each line, and the rightmost name of the currency denomination in each line is right edge justified with the first and second areas. To make alteration even more difficult, the name of the currency denomination corresponding to the multi-letter international monetary code 12 is printed by a series of rows of printed dots that are sufficient in number and spacing so as to provide a darker appearance than the background of the multi-letter international monetary code 12 or the amount 14.

FIGS. 6A through 6E depict various multi-letter international monetary codes printed in conjunction with digits specifying the amount of an instrument, and two overlapping lines which specify the name of the currency denomination. It may be noted that the spacing symbol 37 has been utilized in FIG. 6D at both ends of the second area 27 in lieu of minor digits such as the pair of zeroes that terminate each of the other amounts shown in FIGS. 6A, 6B, 6C, and 6E.

In the example presented herein the English language has been used for the amount of the negotiable instrument and for a symbol such as "PAY ONLY". In countries where other languages are in use, these same entries could be made in the appropriate language. Likewise the selection of a particular number set for the major and minor amount is a matter of choice. The preferred embodiment is to use the letter and number fonts as shown herein in relation to the example of FIG. 3. It should be appreciated that while the multi-letter international monetary code and the major digits of the amount of the instrument have both been described as printed in a negative pattern, if desired the amount may be printed in its entirety in a positive pattern, with only the multi-letter international monetary code printed by means of a negative pattern. Further, although the name of the currency denomination has been shown as printed in overlapping fashion with the amount and the multi-letter international monetary code, if desired the currency denomination may be printed in one or more lines which do not overlap but merely bound the first or second areas, or both such areas.

Having described the invention in detail and by reference to preferred embodiments thereof, it will be apparent that modifications and variations are possible without departing from the scope of the invention defined in the appended claims.

What is claimed is:

1. An international financial instrument comprising a face having a first area and a second area, a multi-letter international monetary code printed on said first area, an amount printed on said second area, said monetary code comprising a three letter code consisting of letters printed in a negative pattern and formed by a series of rows of printed dots to define an outline of each of said letters.

2. The international financial instrument of claim 1 wherein said monetary code is defined by a plurality of adjoining letters in which a single vertical row of dots forms at least a portion of the outline for each of said adjoining letters, thereby making alteration of said monetary code difficulty.

3. The international financial instrument of claim 1 in which a spacing symbol is printed between said first and second areas.

4. The international financial instrument of claim 1 in which the letters making up said multi-letter international monetary code vary in width.

5. The international financial instrument of claim 1 in which said face has a color and wherein sufficient spacing is provided between said rows of dots to create a series of voids through which he color of said face of said international financial instrument can be discerned.

6. The international financial instrument of claim 5 wherein said voids are sufficiently small to render the voids substantially incapable of faithful reproduction by photocopying.

7. The international financial instrument of claim 1 wherein each of said letters printed in a negative pattern includes an open area within which the letter is printed in a smaller size.

8. The international financial instrument of claim 7 in which at least some of said letters printed in a negative pattern include an open area within which the letter is printed twice.

9. An international financial instrument comprising a face having a first area and a second area, a multi-letter international code printed on said first area, an amount printed on said second area, said amount consisting of digits which are printed inn a negative pattern and formed by a series of rows of printed dots that define an outline of each of said digits, said monetary code comprising a three letter code consisting of letters printed in a negative pattern and formed by a series of rows of printed dots to define an outline of each of said letters.

10. The international financial instrument of claim 9 wherein said monetary code is defined by a plurality of adjoining letters in which a single vertical row of dots forms at least a portion of the outline for each of said adjoining letters, thereby making alteration of said monetary code difficult.

11. The international financial instrument of claim 9 in which said face has a color and wherein sufficient spacing is provided between said rows of dots to create a series of voids through which the color of said face of said international financial instrument can be discerned.

12. The international financial instrument of claim 11 wherein said voids are sufficiently small to render the voids substantially incapable of faithful reproduction by photocopying.

13. The international financial instrument of claim 9 wherein each of said letters printed in a negative pattern includes an open area in which the letter is printed.

14. The international financial instrument of claim 13 in which at least some of said letters printed in a negative pattern include an open area in which the letter is printed twice.

15. A method of preparing a secure international financial instrument comprising the steps of:

a) providing an instrument having a first area thereon in which a monetary code, consisting of a three letter code, is to be printed, and a second area thereon n which an amount is to be printed.

b) printing in said first area a monetary code, consisting of a three letter code, using letters printed in a negative pattern formed by a series of rows of printed dots which define the outline of said letters, and c) printing in said second area an amount.

16. The method of claim 15, wherein said step of printing in said first area a monetary code comprises the step of printing said letters with a dot matrix printer.

17. The method of claim 15 wherein said series of rows of printed dots are printed with sufficient spacing to create a series of voids through which the color of said instrument can be discerned.

18. The method of claim 15 wherein the step of printing in said first area a monetary code using letters printed in a negative pattern includes the step of printing each letter with an open area within which the same letter is printed in a positive pattern in a smaller size.

19. The method of claim 15 wherein the step of printing in said first area a monetary code comprises the step of printing a plurality of adjoining letters in which a single row of dots forms at least a portion of the outline for each of said adjoining letters.

20. The method of claim 15 further comprising printing a spacing symbol between said first and second areas.

21. The method of claim 15 wherein the step of printing in said second area an amount comprises the step of printing digits in a negative pattern formed by a series of rows of printed dots which define the outline of said digits.

22. The method of claim 21 wherein said step of printing digits in a negative pattern and formed by a series of rows of printed dots which define the outline of said digits comprises the step of printing said digits with a dot matrix printer.

23. The method of claim 21 in which said face has a color and wherein said series of rows of printed dots are printed with sufficient spacing to create a series of voids through which the color of said instrument can be discerned.

24. The method of claim 15 in which the letters making up said multi-letter international monetary code vary in width.

25. An international financial instrument comprising a face having a first area and a second area, a multi-letter international monetary code printed on said first area, and an amount printed on said second area, said monetary code comprising a three letter code consisting of letters printed in a negative pattern and formed by a series of rows of printed dots to define an outline of each of said letters, and a currency denomination corresponding to said monetary code, said currency denomination consisting of letters printed in at least one line overlapping said first area.

26. The international financial instrument of claim 25 wherein said amount and said monetary code are arranged in a row and in which said at least one line of said currency denomination overlaps said first and second areas.

27. The international financial instrument of claim 26 wherein said currency denomination is printed in two lines, a first line above and a second line below said first and second areas and overlapping therewith.

28. The international financial instrument of claim 26 wherein said currency denomination is repeated in said line.

29. The international financial instrument of claim 28 wherein said currency denomination in said line which is furthest right is right edge justified with said first and second areas.

30. An international financial instrument comprising a face having a first area and a second area, a multi-letter international monetary code printed on said first area, an amount printed on said second area, said monetary code comprising a three letter code consisting of letters printed in a negative pattern and formed by a series of rows of printed dots to define an outline of each of said letters, wherein sufficient spacing is provided between said rows of dots to create a series of voids through which an underlying color on said face of said international financial instrument can be discerned, and a currency denomination corresponding to said monetary code printed in at least one line overlapping said first area by a series of rows of printed dots that are sufficient in number and spacing so as to provide a darker appearance than said monetary code.

31. An international financial instrument comprising a face having a first area and a second area, a multi-letter international monetary code printed on said first area, an amount printed on said second area, said amount consisting of digits which are printed in a negative pattern and formed by a series of rows of printed dots that define an outline of each of said digits, said monetary code comprising a three letter code consisting of letters printed in a negative pattern and formed by a series of rows of printed dots too define an outline of each of said letters, and a currency denomination corresponding to said monetary code, said currency denomination consisting of letters printed in at least one line overlapping said monetary code.

32. The international financial instrument of claim 31 wherein said amount and said monetary code are arranged in a row and in which said line of said currency denomination overlaps said amount and said monetary code.

33. The international financial instrument of claim 32 wherein said currency denomination is printed in two lines, a first line above and a second line below said first and second areas and overlapping therewith.

34. The international financial instrument of claim 32 wherein said currency denomination is repeated in said line.

35. A method of preparing a secure international financial instrument comprising the steps of:

a) providing an instrument having a first area thereon in which an international monetary code, consisting of a three letter code, is to be printed, and a second area thereon in which an amount is to be printed, b) printing in said first area an international monetary code, consisting of a three letter code, in a negative pattern formed by a series of rows of printed dots which define the outline of said letters, c) printing in said second area an amount consisting of digits in a negative pattern formed by a series of rows of printed dots which define the outline of said digits, and said series of rows of printed dots are printed with sufficient spacing to create a series of voids through which an underlying color on said instrument can be discerned, and d) printing a currency denomination corresponding to said monetary code in at least one line overlapping said first area.

36. The method of claim 35 wherein said step of printing said currency denomination comprises the step of printing said currency denomination corresponding to said monetary code in at least one line overlapping said first area by a series of rows of printed dots which are sufficient in number and spacing so as to provide a darker appearance than said monetary code.

37. The method of claim 35 further comprising the steps of arranging said amount and said monetary code in a row and printing said line of said currency denomination overlapping said first and second areas.

38. The method of claim 37 wherein said currency denomination is printed in two lines, a first line above and a second line below said first and second areas overlapping therewith.

39. The method of claim 35 wherein said step of printing said currency denomination comprises the step of printing said currency denomination repeatedly in said line.

40. The method of claim 39 wherein said step of printing said currency denomination comprises the step of right justifying said line of said currency denomination with said first and second areas.

* * * * *

UNITED STATES PATENT AND TRADEMARK OFFICE

CERTIFICATE OF CORRECTION

PATENT NO. : 5,062,666

DATED : November 5, 1991

INVENTOR(S) : William H. Mowry et al

It is certified that error appears in the above-identified patent and that said Letters Patent is hereby corrected as shown below:

Col. 9, line 8, "difficulty" should read --difficult--.

Col. 9, line 37, "inn" should read --in--.

Col. 10, line 2, "n" should read --in--.

Col. 11, line 34, "too" should read --to--.

Signed and Sealed this

Fourth Day of May, 1993

*Attest:*

Michael K. Kirk

MICHAEL K. KIRK

*Attesting Officer*

*Acting Commissioner of Patents and Trademarks*